US010072518B2

(12) United States Patent
Playford et al.

(10) Patent No.: US 10,072,518 B2
(45) Date of Patent: Sep. 11, 2018

(54) WEAR MONITOR FOR AN ABRADABLE LINER FOR A FAN OF A GAS TURBINE ENGINE

(71) Applicant: ROLLS-ROYCE PLC, London (GB)

(72) Inventors: William Playford, Cambridge (GB); James O'Toole, Derby (GB)

(73) Assignee: ROLLS-ROYCE PLC, London (GB)

( * ) Notice: Subject to any disclaimer, the term of this patent is extended or adjusted under 35 U.S.C. 154(b) by 277 days.

(21) Appl. No.: 14/816,518

(22) Filed: Aug. 3, 2015

(65) Prior Publication Data

US 2016/0061049 A1 Mar. 3, 2016

(30) Foreign Application Priority Data

Aug. 28, 2014 (GB) ..... 1415200.3

(51) Int. Cl.
*F01D 11/12* (2006.01)

(52) U.S. Cl.
CPC ..... *F01D 11/122* (2013.01); *F05D 2230/31* (2013.01); *F05D 2260/80* (2013.01)

(58) Field of Classification Search
CPC .... F01D 11/12; F01D 11/122; F05D 2230/31; F05D 2230/90
See application file for complete search history.

(56) References Cited

U.S. PATENT DOCUMENTS 4,774,150 A * 9/1988 Amano ..... C23C 4/02 116/200
6,073,358 A 6/2000 Nguyen
2004/0047726 A1* 3/2004 Morrison ..... F01D 9/04 415/116
2008/0131699 A1* 6/2008 Vance ..... C04B 41/009 428/411.1
2015/0345326 A1* 12/2015 Robertson, Jr. ..... F01D 25/005 415/9

FOREIGN PATENT DOCUMENTS

EP 2233600 A1 9/2010
GB 2449708 A 12/2008

OTHER PUBLICATIONS

Mar. 20, 2015 Search Report issued in British Patent Application No. 1415200.3.

* cited by examiner

*Primary Examiner* — Logan Kraft
*Assistant Examiner* — Peter T Hrubiec
(74) *Attorney, Agent, or Firm* — Oliff PLC

(57) ABSTRACT

An abradable liner suitable for a gas turbine engine fan stage, comprising a plurality of abradable layers that are bonded together, wherein at least one visual indicator is embedded in the plurality of abradable layers, the visual indicators can be coloured strips of material and may be at a given depth, and may be in an independent element or layer located in between other layers.

14 Claims, 2 Drawing Sheets

WEAR MONITOR FOR AN ABRADABLE LINER FOR A FAN OF A GAS TURBINE ENGINE

TECHNICAL FIELD OF INVENTION

This invention relates to an abradable liner for a fan of a gas turbine engine. In particular, the invention relates to a wear indication system incorporated into the abradable liner.

BACKGROUND OF INVENTION

FIG. 4 shows a typical three shaft gas turbine engine 10. The gas turbine engine 10 includes an air intake 12, a fan 14 having rotating blades 16, a bypass duct 18 and an engine core 20. The engine core 20 includes an intermediate pressure compressor 22, a high pressure compressor 24, a combustor 26, a turbine arrangement comprising a high pressure turbine 28, an intermediate pressure turbine 30, a low pressure turbine 32 and an exhaust nozzle 34. Air entering the intake 12 is accelerated by the fan 14 and directed into two air flows. The first air flow passes into the engine core 20, and the second air flows along the bypass 18 to provide propulsive thrust.

The engine core air flow travels through the intermediate 22 and high 24 pressure compressors in turn. The compressed air exhausted from the high pressure compressor 24 is mixed with fuel and burnt in the combustor 26. The hot gas expands through and drives the high 28, intermediate 30 and low 32 pressure turbines before being exhausted through the nozzle 34 and adding to the propulsive thrust created by the first air flow. The high 28, intermediate 30 and low 32 pressure turbines respectively drive the high 24 and intermediate 22 pressure compressors and the fan 14 via respective shafts 36, 38, 40.

It is well known that to maintain an efficient gas turbine engine the gap between fan blade tips and the engine casing is closely controlled to minimise the leakage of compressed air over the blade tips and back upstream. To this end, the engine casings often include an attrition or abradable liner which provides a close fitting seal with the blade tips. The abradable liner is initially installed so as to be in contact with the fan blade tips such that the liner is scored by the rotating fan (or compressor as the case may be) during the first few rotations which removes enough material to allow a close fitting free rotation of the blades.

However, during normal engine use the radial position of the rotating blade tips move due to, for example, centrifugal forces, thermal expansion and vibration, and also during harsh operating conditions such as heavy landings or sharp manoeuvres.

This can cause in-service damage to the attrition liner, which, in severe cases, can erode large arcuate sections which then require replacement. Replacement of the liners is expensive both in terms of overhaul cost and the associated loss of service of the engine.

The present invention seeks to provide a solution to help monitor and control attrition liner damage.

STATEMENTS OF INVENTION

In a first aspect the present invention provides an abradable liner for a gas turbine engine fan stage, comprising: a plurality of abradable layers, wherein at least one visual indicator is embedded in the plurality of abradable layers.

The visual indicators can be coloured strips of material. The strips may be placed towards the leading edge and trailing edges of the blade only. The plurality of embedded visual indicators can be at different layers.

The plurality of visual indicators may be at a given depth. At least one visual indicator may extend at least between the trailing edge and leading edge of the rotational path of the fan blade tip.

The abradable liner may comprise a plurality of arcuate segments releasably attached to each other to form an annular liner. There may be greater than ten segments. Preferably, there are sixteen segments.

The visual indicators may include one of the materials in a group comprising dye and adhesive. The visual indicators may be in an independent element or layer located in between other layers. Alternatively or additionally, the visual indicator may be a coloured portion of another layer.

The thickness of visual indicator will be greater than approximately 100 microns. Preferably, the thickness of the visual indicator will be less than 1 mm thick. The width of the visual indicator may be between 5 and 50 mm. Preferably, the width of the visual indicator will be between 5 and 10 mm.

DESCRIPTION OF DRAWINGS

An embodiment of the invention is described below with the aid of the accompanying drawings in which.

DETAILED DESCRIPTION OF INVENTION

Figure 1:
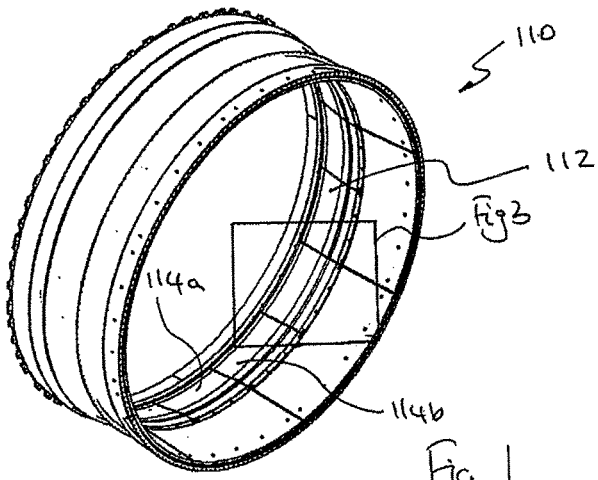
FIG. 1 shows a fan casing having a segmented annular attrition liner for use with a gas turbine engine.
Figure 2:
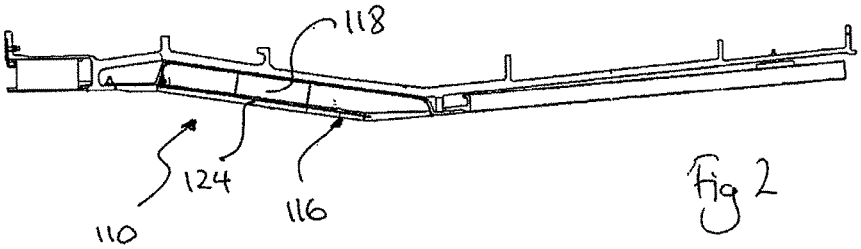
FIG. 2 shows a cross section of an attrition liner in accordance with the present invention.
Figure 4:
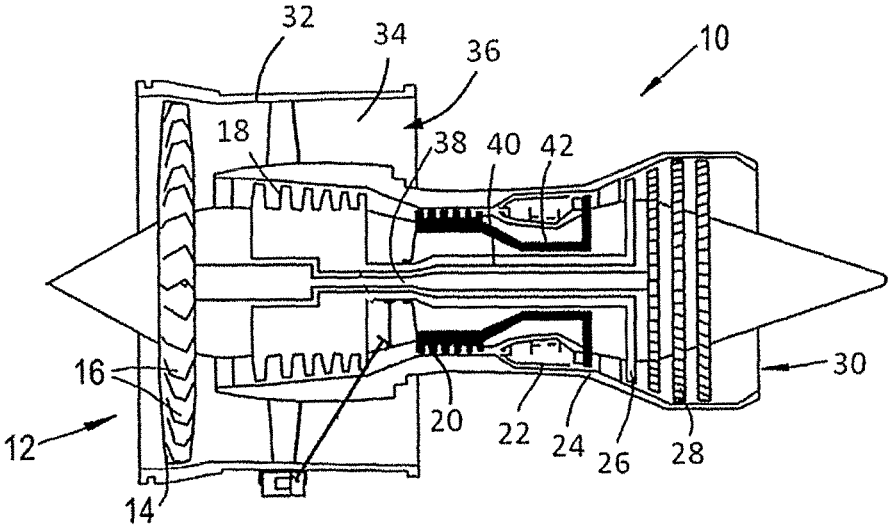
FIG. 4 shows a cross section of a conventional gas turbine engine

FIGS. 1 and 2 respectively show a perspective and cross section of a fan casing 110 having an attrition liner 112 which incorporates an annulus of abradable material. In use, the liner 112 is located around the fan blade 16 as shown in FIG. 4 so as to provide a sealing function.

The attrition liner 112 is made up from a plurality of segmented sections 114*a*, 114*b*, sixteen segments in the embodiment, which are releasably attached together using conventional bolts (not shown). Having a segmented design is particularly advantageous as it allows the liner to be partially replaced in accordance with a given wear pattern or sight of damage.

Each segment 114*a, b,* is substantially identical in so far as the attrition liner is concerned and includes a plurality of layers which are bonded to one another to form a laminated structure. The liner includes an abradable portion 116 which is designed to be contacted and abraded by the fan blade in use. The abradable portion may be any suitable type known in the industry such as polyester based laminate. The abradable portion 116 is backed and supported by a substrate in the form of an aluminium honeycomb 118 structure.

The liner is generally constructed by adhering the various layers together with a suitable adhesive. Typically, these may include an epoxy based adhesive, or a silicon based adhesive as are well known to those in the art. It will be appreciated that other layers may be included in the attrition liners as required per the application. For example, there may be an intermediary layer of a glass reinforced plastic (GRP) between the supporting substrate and abradable portion.

In addition to the basic construction of the liner, there are placed visual indicators in the form of a strips and layers of coloured material embedded in the structure. The coloured material may take any suitable form but preferentially a coloured strip or pattern within an adhesive layer or an intermediary layer such as the GRP layer. Hence, the coloured material is presented within a layer such that it becomes exposed as the liner wears away during use.

The coloured strip or pattern may be provided by a dye or within an independent element in the form of a strip or T strip which is adhered to the other layers during construction. The independent element may be constructed from a relatively soft material such as steel or aluminium to help prevent damage to the blade tip when being exposed. The thickness of the layer will be application specific but typically in the region of 1 mm or less.

Figure 3:
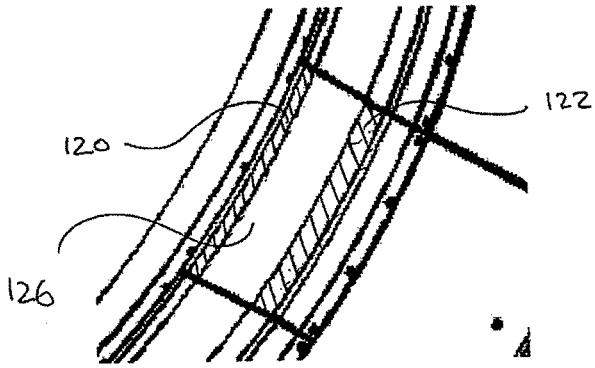
FIG. 3 shows a section of the fan casing and an exposed layer of indicator within the attrition liner.

There are three different types of markers provided in the liners. The first are strip markers 120, 122, as shown in FIG. 3 which are located respectively towards the leading and trailing edges of the rotative path of the fan blade. These strip markers 120, 122, extend around the full circumference of the annulus and are axially positioned where tip rub from the fan blades is typically greatest.

The leading and trailing edge strip markers are between approximately 5 mm and 20 mm wide and less than 1 mm thick. However, the strips may be wider than this and may be between 5 and 50 mm if required by a particular construction of liner or rub pattern. The colour of the material can be associated with a given amount of wear and provide maintenance personal with an indication that an overhaul is due for the aircraft or should be scheduled.

The second type of marker used in the described embodiment is a pre-failure marker 124 which is located towards radially outer edge of the liner, as shown in FIG. 2. The exposure of this layer is indicative of a maximum tolerable wear and may indicate that a failure of the liner is imminent.

The third marker is a layer of markers 126 placed at the same radial depth as the strip markers. This layer allows a non-uniform wear pattern to be detected once the overhaul markers have been exposed.

With the exception of where the panels meet, the markers may be a continuous band around the liner or may be a broken line or strip. Alternatively, the markers may have a particular pattern to aid with the visual detection when being exposed.

The invention provides a simple mechanical visual indication which can be used to provide quick and reliable information as to the extent and pattern of wear in an attrition liner. This can be used by maintenance staff to determine when an engine requires an overhaul and allows for efficient scheduling.

The invention claimed is:

1. A fan casing abradable liner for a gas turbine engine fan stage, comprising:

a plurality of abradable layers bonded together, wherein at least one visual indicator is embedded in the plurality of abradable layers, wherein the, or each, visual indicator are coloured strips of material provided within an independent element separate from the abradable layers.

2. A fan casing abradable liner as claimed in claim 1 wherein the strips are placed towards the leading edge and trailing edges of the blade.

3. A fan casing abradable liner as claimed in claim 1, wherein the at least one visual indicator is located at a radially outer edge of the liner at a depth which is indicative of a maximum tolerable wear for the liner.

4. A fan casing abradable liner as claimed in claim 1 comprising a plurality of embedded visual indicators at different layers.

5. A fan casing abradable liner as claimed in claim 4 wherein the plurality of embedded visual indicators are different colours.

6. A fan casing abradable liner as claimed in claim 4 wherein at least one visual indicator extends at least between the trailing edge and leading edge of the rotational path of the fan blade tip.

7. A fan casing abradable liner as claimed in claim 1 wherein the abradable liner comprises a plurality of arcuate segments releasably attached to each other to form an annular liner.

8. A fan casing abradable liner as claimed in claim 7 wherein there are greater than ten segments.

9. A fan casing abradable liner as claimed in claim 1 wherein the, or each, visual indicator includes one of the materials in a group comprising dye and adhesive.

10. A fan casing abradable liner as claimed in claim 1 wherein the, or each, visual indicator has a radial thickness of less than 1 mm.

11. A fan casing abradable liner as claimed in claim 1 wherein the abradable layers are made of a polyester based laminate.

12. A fan casing abradable liner as claimed in claim 1 wherein layers of the liner are adhered together with an adhesive.

13. A fan casing abradable liner as claimed in claim 12 wherein the adhesive is an epoxy based adhesive or a silicon based adhesive.

14. A fan casing abradable liner as claimed in claim 1 wherein an intermediary layer of a glass reinforced plastic is present between the abradable layers and a supporting substrate of the liner.

* * * * *